US006582247B2

(12) United States Patent
Siemon

(10) Patent No.: US 6,582,247 B2
(45) **Date of Patent: *Jun. 24, 2003**

(54) CONNECTING BLOCK WITH STAGGERED IDCS

(75) Inventor: John A. Siemon, Woodbury, CT (US)

(73) Assignee: The Siemon Company, Watertown, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/576,829

(22) Filed: May 23, 2000

(65) Prior Publication Data

US 2002/0048997 A1 Apr. 25, 2002

Related U.S. Application Data

(60) Provisional application No. 60/156,780, filed on Sep. 30, 1999.

(51) Int. Cl.[7] ..... H01R 4/24

(52) U.S. Cl. ..... 439/405

(58) Field of Search ..... 439/405, 922, 439/941, 418, 395, 620, 497, 108

(56) References Cited

U.S. PATENT DOCUMENTS

| | | | | | |
|---|---|---|---|---|---|
| 5,224,867 | A | * | 7/1993 | Ohtsuki et al. | 439/108 |
| 5,536,182 | A | * | 7/1996 | Atoh et al. | 439/404 |
| 5,951,321 | A | * | 9/1999 | Jagg | 439/405 |
| 6,077,105 | A | * | 6/2000 | Jochen et al. | 439/497 |
| 6,080,020 | A | * | 6/2000 | Grabbe | 439/620 |
| 6,123,566 | A | * | 9/2000 | Daoud et al. | 439/409 |
| 6,183,306 | B1 | * | 2/2001 | Caveney | 439/676 |

OTHER PUBLICATIONS

Panduit GIGA–Punch Data Sheet, Panduit Corp. 1999.

* cited by examiner

*Primary Examiner*—P. Austin Bradley
*Assistant Examiner*—Phoungchi T Nguyen
(74) *Attorney, Agent, or Firm*—Cantor Colburn LLP

(57) ABSTRACT

A connecting block with a plurality of staggered pairs of Insulative Displacement Contacts (IDCs) for terminating pairs of wires is provided. The connecting block comprises a molded plastic housing and can accommodate a two-pair or four-pair IDC configuration. The pairs of IDCs are positioned in multiple staggered rows for the purpose of minimizing crosstalk.

11 Claims, 5 Drawing Sheets

CONNECTING BLOCK WITH STAGGERED IDCS

CROSS REFERENCE TO RELATED APPLICATIONS

This application claims the benefit of U.S. provisional application Ser. No. 60/156,780 filed Sep. 30, 1999, the entire contents of which are incorporated herein by reference.

BACKGROUND OF THE INVENTION

Current 110 type connecting systems provide a flexible means of connecting or cross-connecting horizontal and backbone wiring within a building to either end-user equipment or communications networking. The 110 type connecting systems are designed to support digital data transmission as well as analog/digital voice over unshielded twisted pair (UTP) media through the use of wiring blocks, connecting blocks and patch cords or jumpers.

The connecting blocks employed utilize punch down Insulation Displacement Contacts (IDCs) to maximize density and ease of use. The conventional block system comprises IDCs that are aligned in a single row. As the rate of transmission increases within the system, radiation levels increase as well, causing near end crosstalk between IDC pairs. This crosstalk is not problematic when transmission occurs at low frequencies (around 16 Mhz), however, as the rate of transmission increases up to 400 Mhz the higher radiation levels produce a greater incidence of crosstalk. To reduce this crosstalk, connecting blocks have been developed utilizing conductive shields (plates) between adjacent pairs of IDCs.

SUMMARY OF THE INVENTION

The connecting block system of this invention includes a molded plastic housing which contains a number of conductive Insulation Displacement Contacts (IDCs) positioned in multiple staggered rows.

BRIEF DESCRIPTION OF THE DRAWINGS

Referring now to the drawings wherein like elements are numbered alike in the several Figures.

DETAILED DESCRIPTION OF THE PREFERRED EMBODIMENTS

Figure 1A:
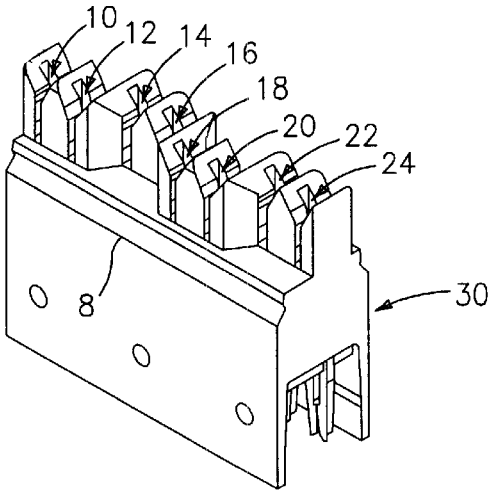
FIGS. 1A through 1F represent a first embodiment illustrating IDC pairs staggered upon two axes.
Figure 1C:
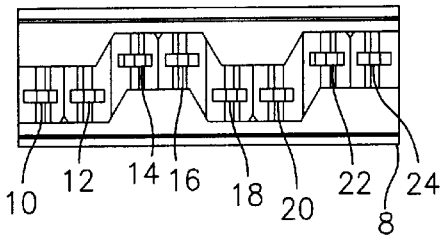
Figure 1F:
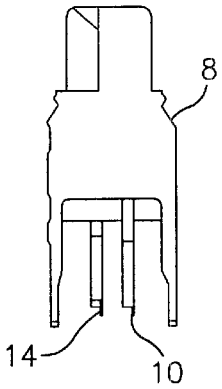
Figure 1D:
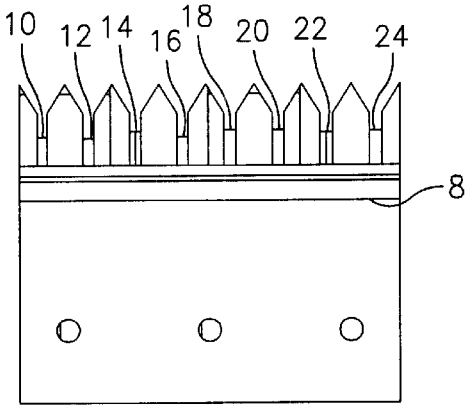
Figure 1B:
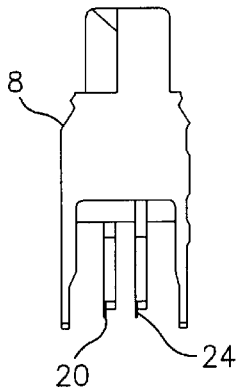
Figure 1E:
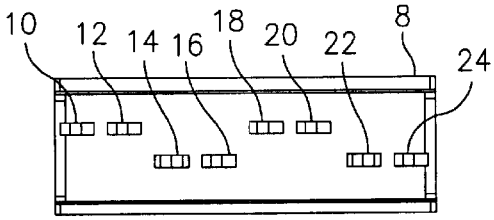

Referring to FIGS. 1A through 1F, an exemplary embodiment of the present invention includes a connecting block shown generally at 30, wherein 8 IDCs are paired and staggered along 2 axes. FIG. 1A is an isometric view of the connecting block 30. FIGS. 1B, 1C, 1D, 1E and 1F, are front, top, side, bottom and rear views, respectively, of the connecting block 30. It will be appreciated that FIGS. 1A, 1C, 1D, and 1E depict connecting block 30 with a plurality of IDCs numbered 10, 12, 14, 16, 18, 20, 22, and 24, while FIGS. 1B and 1F depict only IDCs numbered 20, 24 and 14, 10 respectively. Each IDC in said connecting block comprises a pair of insulation penetrating contacts for terminating a pair of wires. IDCs 10 and 12 are paired and used for terminating a first pair of tip and ring wires. IDCs 14 and 16 are paired and used for terminating a second pair of tip and ring wires. IDCs 18 and 20 are paired and used for terminating a third pair of tip and ring wires. IDCs 22 and 24 are paired and used for terminating a fourth pair of tip and ring wires.

Referring to FIGS. 1A through 1F, IDCs 10, 12, 18, and 20 are aligned on a first axis. The first axis is a first distance from edge 8. IDCs 14, 16, 22, and 24 are aligned on a second axis. The second axis is a second distance from edge 8. The first and second axes are linear and parallel. It is understood that the location of the first and second axes need not be referenced from only edge 8. Any reference on the connecting block may be used to indicate the position of the first axis and the second axis.

Figure 2A:
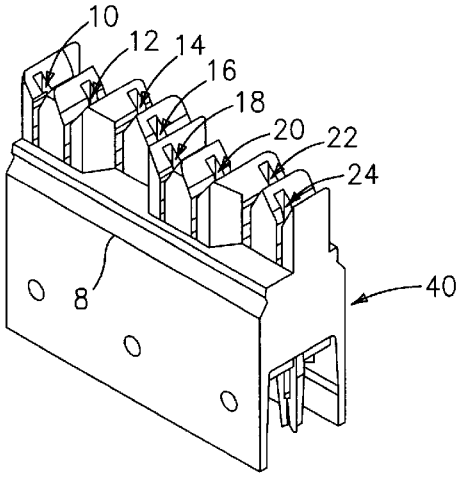
FIGS. 2A through 2F represent a second embodiment illustrating IDCs staggered within each pair upon three axes.
Figure 2C:
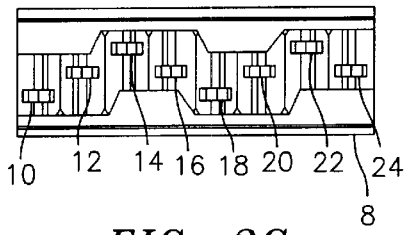
Figure 2F:
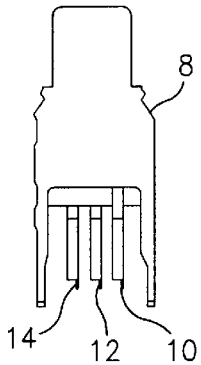
Figure 2D:
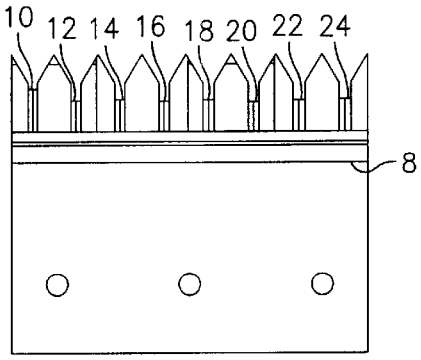
Figure 2B:
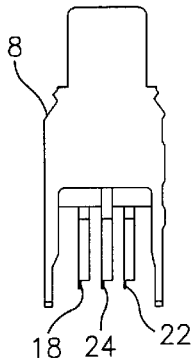
Figure 2E:
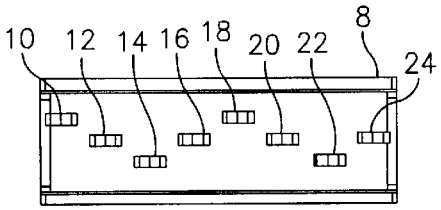

FIGS. 2A through 2F illustrate a second embodiment of a connecting block shown generally at 40, wherein 8 IDCs are staggered within pairs and upon 3 different axes. FIG. 2A is an isometric view of the connecting block 40. FIGS. 2B, 2C, 2D, 2E and 2F, are front, top, side, bottom and rear views, respectively, of the connecting block 40. It will be appreciated that FIGS. 2A, 2C, 2D, and 2E depict connecting block 40 with a plurality of IDCs numbered 10, 12, 14, 16, 18, 20, 22, and 24, while FIGS. 2B and 2F depict only IDCs numbered 18, 24, 22 and 14, 12, 10 respectively. Each IDC in said connecting block 40 comprises a pair of insulation penetrating contacts for terminating a pair of wires. IDCs 10 and 12 are paired and used for terminating a first pair of tip and ring wires. IDCs 14 and 16 are paired and used for terminating a second pair of tip and ring wires. IDCs 18 and 20 are paired and used for terminating a third pair of tip and ring wires. IDCs 22 and 24 are paired and used for terminating a fourth pair of tip and ring wires.

Referring to FIGS. 2A through 2F, IDCs 10 and 18 are aligned on a first axis. The first axis is a first distance from edge 8. IDCs 12, 16, 20, and 24 are aligned on a second axis. The second axis is a second distance from edge 8. IDCs 14 and 22 are aligned on a third axis. The third axis is a third distance from edge 8. The first, second and third axes are linear and parallel. It is understood that the location of the first, second and third axes need not be referenced from only edge 8. Any reference on the connecting block may be used to indicate the position of the first, second and third axes.

Figure 3A:
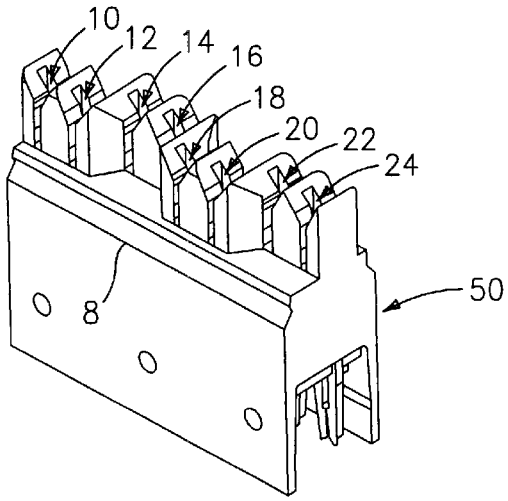
FIGS. 3A through 3F represent a third embodiment illustrating IDCs staggered within each pair upon four axes.
Figure 3C:
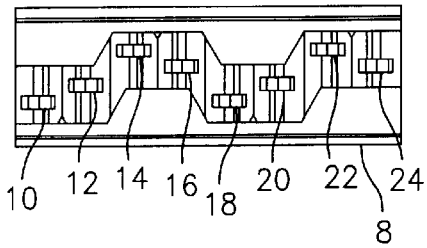
Figure 3F:
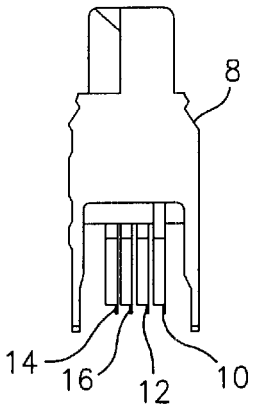
Figure 3D:
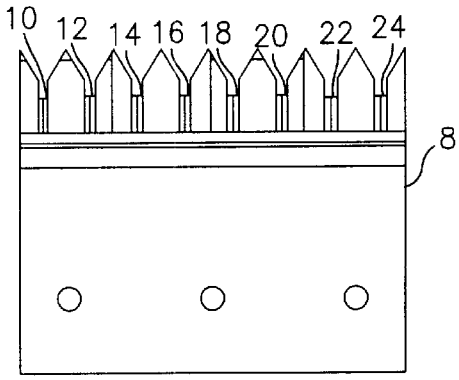
Figure 3B:
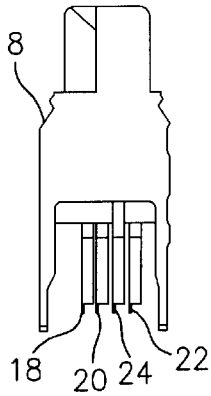
Figure 3E:
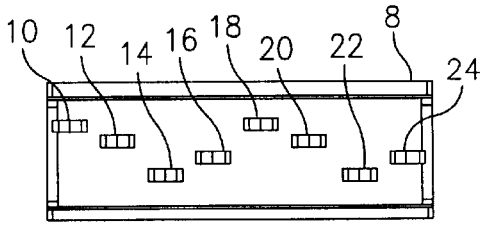

FIGS. 3A through 3F illustrate a third embodiment of a connecting block shown generally at 50 wherein 8 IDCs are staggered within pairs and aligned on four axes. FIG. 3A is an isometric view of the connecting block 50. FIGS. 3B, 3C, 3D, 3E and 3F, are front, top, side, bottom and rear views, respectively, of the connecting block 50. It will be appreciated that FIGS. 3A, 3C, 3D, and 3E depict a connecting block 50 with a plurality of IDCs numbered 10, 12, 14, 16, 18, 20, 22, and 24, while FIGS. 3B and 3F depict only IDCs numbered 18, 20, 24, 22 and 14, 16, 12, 10 respectively. Each IDC in said connecting block 50 comprises a pair of insulation penetrating contacts for terminating a pair of wires. IDCs 10 and 12 are paired and used for terminating a first pair of tip and ring wires. IDCs 14 and 16 are paired and used for terminating a second pair of tip and ring wires. IDCs 18 and 20 are paired and used for terminating a third pair of tip and ring wires. IDCs 22 and 24 are paired and used for terminating a fourth pair of tip and ring wires.

Referring to FIGS. 3A through 3F, IDCs 10 and 18 are aligned on a first axis. The first axis is a first distance from edge 8. IDCs 12 and 20 are aligned on a second axis. The second axis is a second distance from edge 8. IDCs 14 and 22 are aligned on a third axis. The third axis is a third distance from edge 8. IDCs 16 and 24 are aligned on a fourth axis. The fourth axis is a fourth distance from edge 8. The first, second, third and fourth axes are linear and parallel. It is understood that the location of the first, second, third and fourth axes need not be referenced from only edge 8. Any reference on the connecting block may be used to indicate the position of the first, second, third and fourth axes.

Figure 4A:
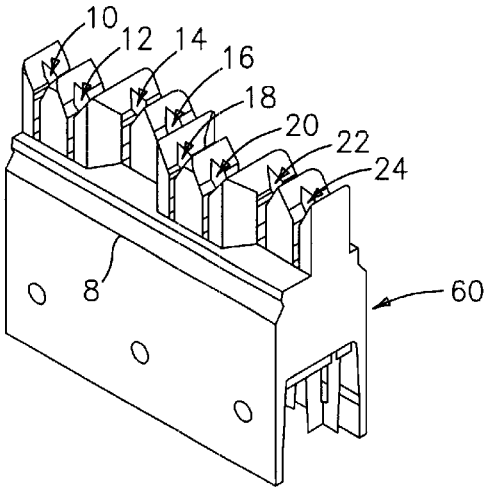
FIGS. 4A through 4F represent a fourth embodiment illustrating IDC pairs which are angled and staggered upon two axes.
Figure 4C:
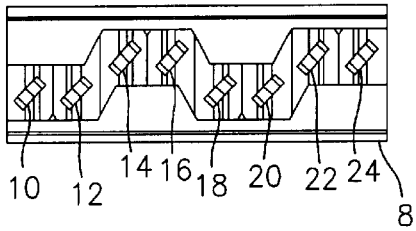
Figure 4F:
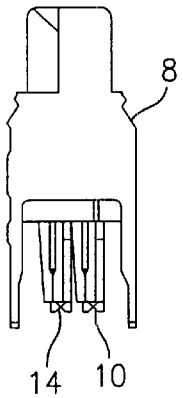
Figure 4D:
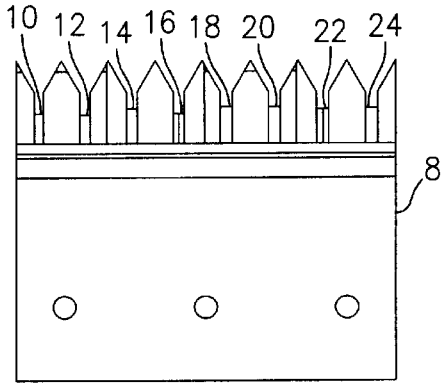
Figure 4B:
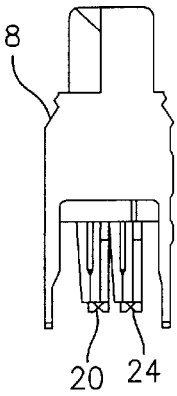
Figure 4E:
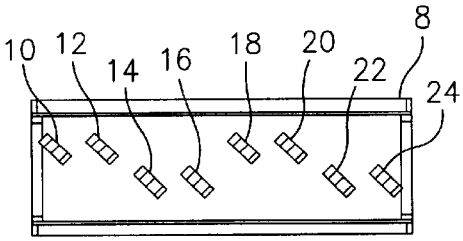

FIGS. 4A through 4F illustrate a fourth embodiment of a connecting block shown generally at 60 wherein 8 IDCs are paired and staggered upon two axes. Each IDC is angled with respect to a corresponding axis. FIG. 4A is an isometric view of the connecting block 60. FIGS. 4B, 4C, 4D, 4E and 4F, are front, top, side, bottom and rear views, respectively, of the connecting block 60. It will be appreciated that FIGS. 4A, 4C, 4D, and 4E depict connecting block 60 with a plurality of IDCs numbered 10, 12, 14, 16, 18, 20, 22, and 24, while FIGS. 4B and 4F depict only IDCs numbered 24, 20 and 14, 10 respectively. Each IDC in said connecting block 60 comprises a pair of insulation penetrating contacts for terminating a pair of wires. IDCs 10 and 12 are paired and used for terminating a first pair of tip and ring wires. IDCs 14 and 16 are paired and used for terminating a second pair of tip and ring wires. IDCs 18 and 20 are paired and used for terminating a third pair of tip and ring wires. IDCs 22 and 24 are paired and used for terminating a fourth pair of rip and ring wires.

Referring to FIGS. 4A through 4F, IDCs 10, 12, 18, and 20 are aligned on a first axis and angled with respect to the first axis. The first axis is a first distance from edge 8. IDCs 14, 16, 22, and 24 are aligned on a second axis angled with respect to the second axis. The second axis is a second distance from edge 8. It is understood that the location of the first and second axes need not be referenced from only edge 8. Any reference on the connecting block may be used to indicate the position of the first axis and the second axis.

Figure 5:
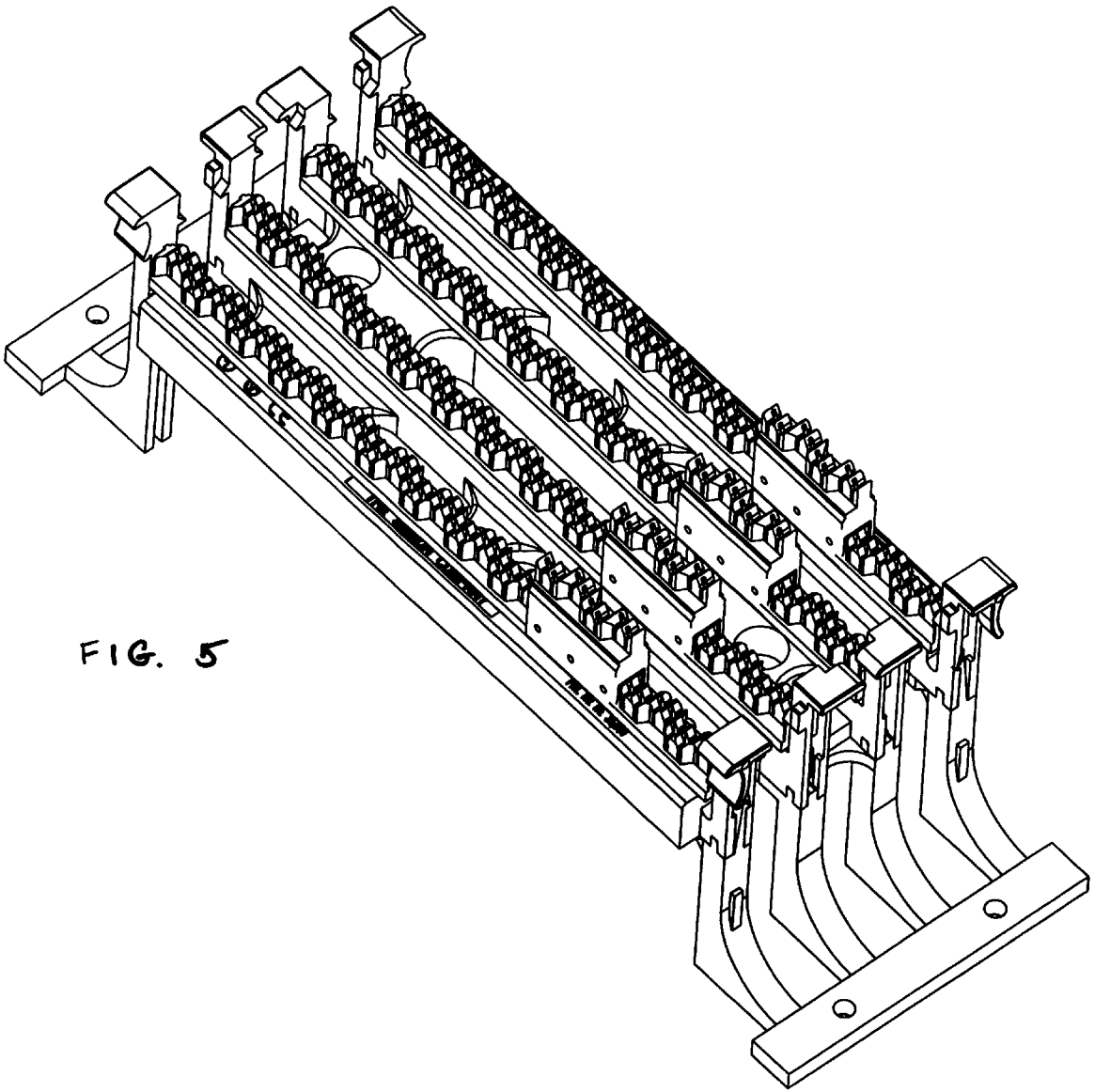
FIG. 5 represents an isometric view of a 110 type wiring block (or base) compatible for use with the connecting block set forth in FIGS. 1A through 1F.

FIG. 5 represents an isometric view of a wiring block with four connecting blocks that utilize the configuration set forth in FIGS. 1A through 1F above.

As the present invention is directed to improvements in the location of connecting block IDCs, the details of the connecting block are not fully disclosed in the drawings and description herein. Such details are known in the art as provided, for example, in U.S. Pat. No. 4,964,812.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A connecting block comprising:

a housing having a first edge along a first sidewall and a second edge along a second sidewall opposite said first sidewall, a first end wall between the first and second sidewalls and a second end wall opposite said first end wall between the first and second sidewalls;

a pair of first and second insulation penetrating contacts in said housing between said first and second sidewalls connected to a first pair of tip and ring wires; wherein said first and second insulation penetrating contacts are aligned on a first axis in said housing; and a pair of third and fourth insulation penetrating contacts in said housing between said first and second sidewalls connected to a second pair of tip and ring wires; wherein said third and fourth insulation penetrating contacts are aligned on a second axis in said housing;

said first axis is a first distance from said first edge of said connecting block and said second axis is a second distance from said first edge of said connecting block, said first contact being positioned closest to said first end wall, said second contact being second closest to the first end wall, said third contact being third closest to the first end wall and said fourth contact being fourth closest to the first end wall;

a pair of fifth and sixth insulation penetrating contacts in said housing connected to a third pair of tip and ring wires; wherein said fifth and sixth insulation penetrating contacts are aligned on said first axis in said housing.

2. The connecting block of claim 1, further comprising:

a pair of seventh and eighth insulation penetrating contacts in said housing connected to a fourth pair of tip and ring wires; wherein said seventh and eighth insulation penetrating contacts are aligned on said second axis in said housing.

3. The connecting block of claim 1, wherein a first distance between said first contact and said second contact is less than a second distance between the second contact and the third contact.

4. The connecting block of claim 1, wherein said first axis and said second axis are parallel.

5. A connecting block comprising:

a housing having a first edge;

a pair of first and second insulation penetrating contacts in said housing connected to a first pair of tip and ring wires; wherein said first insulation penetrating contact is aligned on a first axis in said housing and said second insulation penetrating contact is aligned on a second axis in said housing; and a pair of third and fourth insulation penetrating contacts in said housing connected to a second pair of tip and ring wires; wherein said third insulation penetrating contact is aligned on a third axis in said housing and said fourth insulation penetrating contact is aligned on said second axis in said housing;

a pair of fifth and sixth insulation penetrating contacts in said housing connected to a third pair of tip and ring wires; wherein said fifth insulation penetrating contact is aligned on said first axis in said housing and said sixth insulation penetrating contact is aligned on said second axis in said housing.

6. The connecting block of claim 5, further comprising:

a pair of seventh and eighth insulation penetrating contacts in said housing connected to a fourth pair of tip and ring wires; wherein said seventh insulation penetrating contact is aligned on said third axis in said housing and said eighth insulation penetrating contact is aligned on a second axis in said housing.

7. The connecting block of claim 5, wherein:

said first axis is a first distance from said first edge of said housing, said second axis is a second distance from said first edge of said housing, and said third axis is a third distance from said first edge of said housing.

8. The connecting block of claim 5 wherein said first axis, said second axis and said third axis are parallel.

9. A connecting block comprising:

a housing having a first edge along a first sidewall and a second edge along a second sidewall opposite said first sidewall, a first end wall between the first and second sidewalls and a second end wall opposite said first end wall between the first and second sidewalls;

a pair of first and second insulation penetrating contacts in said housing between said first and second sidewalls connected to a first pair of tip and ring wires; wherein said first and second insulation penetrating contacts are:
aligned on a first axis in said housing, and
are angled with respect to said first axis; and a pair of third and fourth insulation penetrating contacts in said housing between said first and second sidewalls connected to a second pair of tip and ring wires; wherein said third and fourth insulation penetrating contacts are:
aligned on a second axis in said housing, and
are angled with respect to said second axis said first axis is a first distance from said first edge of said connecting block and said second axis is a second distance from said first edge of said connecting block, said first contact being positioned closest to said first end wall, said second contact being second closest to the first end wall, said third contact being third closest to the first end wall and said fourth contact being fourth closest to the first end wall;

a pair of fifth and sixth insulation penetrating contacts in said housing connected to a third pair of tip and ring wires; wherein said fifth and sixth insulation penetrating contacts are: aligned on said first axis in said housing, and are angled with respect to said first axis.

10. The connecting block of claim 7, further comprising:

a pair of seventh and eighth insulating penetrating contacts in said housing connected to a fourth pair of tip and ring wires; wherein said seventh and eighth insulation penetrating contacts are:
aligned on a second axis in said housing, and
are angled with respect to said second axis.

11. The connecting block of claim 9 wherein said first and second axes are parallel.

* * * * *

UNITED STATES PATENT AND TRADEMARK OFFICE

CERTIFICATE OF CORRECTION

PATENT NO. : 6,582,247 B2
APPLICATION NO. : 09/576829
DATED : June 24, 2003
INVENTOR(S) : John A. Siemon It is certified that error appears in the above-identified patent and that said Letters Patent is hereby corrected as shown below:

Title Page,
Item (54), Title, after "STAGGERED", delete "IDCS" and insert therefor --IDCs--.

Column 1,
Line 1, after "STAGGERED", delete "IDCS" and insert therefor --IDCs--.

Column 6,
Line 12, after "claim", delete "7" and insert therefor --9--.

Signed and Sealed this

Fifth Day of June, 2007

JON W. DUDAS
*Director of the United States Patent and Trademark Office*